United States Patent [19]

Hutchins et al.

[11] Patent Number: 4,592,170

[45] Date of Patent: Jun. 3, 1986

[54] ORBITAL ABRADING OR POLISHING TOOL

[75] Inventors: Alma A. Hutchins, Pasadena; Donald H. Hutchins, Sierra Madre; Ronald Boord, Pasadena, all of

[73] Assignee: Hutchins Manufacturing Company, Pasadena, Calif.

[21] Appl. No.: 641,778

[22] Filed: Aug. 17, 1984

[51] Int. Cl.[4] ..... B24B 23/00

[52] U.S. Cl. ..... 51/170 MT

[58] Field of Search ..... 51/170 TL, 170 T, 170 MT, 51/170 R

[56] References Cited

U.S. PATENT DOCUMENTS 4,355,487 10/1982 Maier et al. ..... 51/170 MT

FOREIGN PATENT DOCUMENTS 2025208 12/1971 Fed. Rep. of Germany ..... 51/170 MT
2289296 5/1976 France ..... 51/170 TL
697685 9/1953 United Kingdom ..... 51/170 MT
1407628 9/1975 United Kingdom ..... 51/170 MT

OTHER PUBLICATIONS

Hutchins' Advertising Brochure, Model 4500 and Model 4950 VA, HPL-82.

National-Detroit, Inc. Price List, Model 400, Form 400-4/80.

Rodac Pneumatic Tools Parts List, Model Nos. 2010-2007, 9/1974.

Rodac Pneumatic Tools Parts List, Model No. 2000, 3/1974.

Black & Decker Bulletin, No. 272, Air Jitterbug Sander, Cat. No. 6166, Type 3, Form No. 97950-01PS.

*Primary Examiner*—Roscoe V. Parker

*Attorney, Agent, or Firm*—William P. Green

[57] ABSTRACT

A portable abrading or polishing tool having a body adapted to be held by a user to manipulate the tool and carrying a motor which drives orbitally a part to which a head or shoe adapted to carry a sheet of sandpaper or the like is detachably connected for orbital abrading or polishing movement with the part. The head is attached to the part by a fastener, preferably a screw extending through an opening in a backing plate of the head, and is retained against rotation by an essentially tubular member or boot of flexible preferably elastomeric material extending between the body structure and the head. The tubular member has a first end which may be disposed about a portion of the body structure and be clamped thereto to detachably secure the head assembly to the body, and has a second end which is detachably connectable to the head, in a manner enabling alternate use of any of two or more heads of different shapes and sizes with the same motor and handle assembly. To facilitate and simplify the change of heads, the device is so designed that a single threaded fastener serves to attach the head to both the orbital drive element and the flexible tubular member which retains the head against rotation as it revolves orbitally.

17 Claims, 10 Drawing Figures

FIG. 7
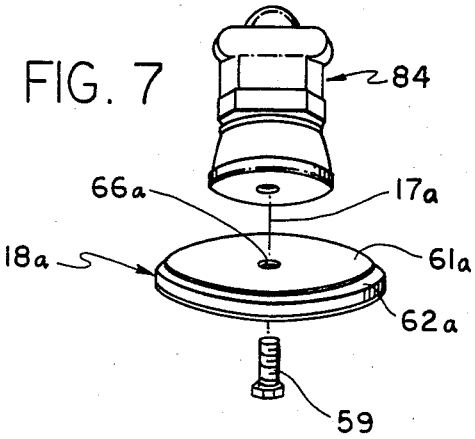
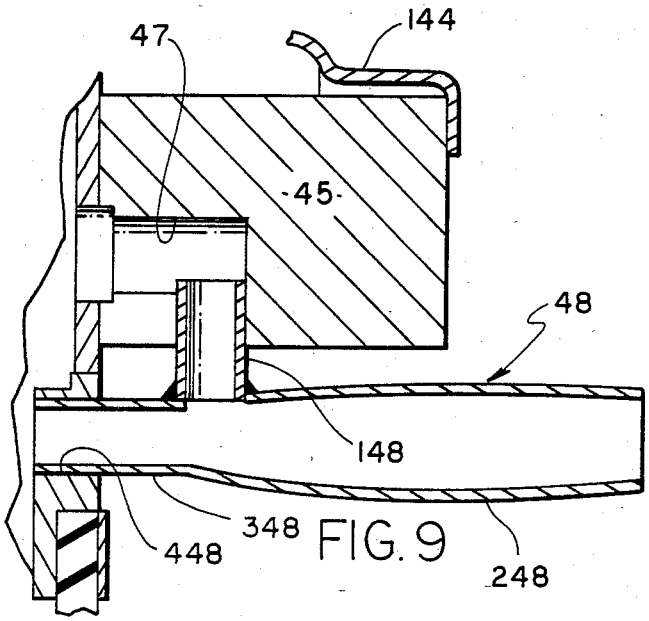
FIG. 9
FIG. 8
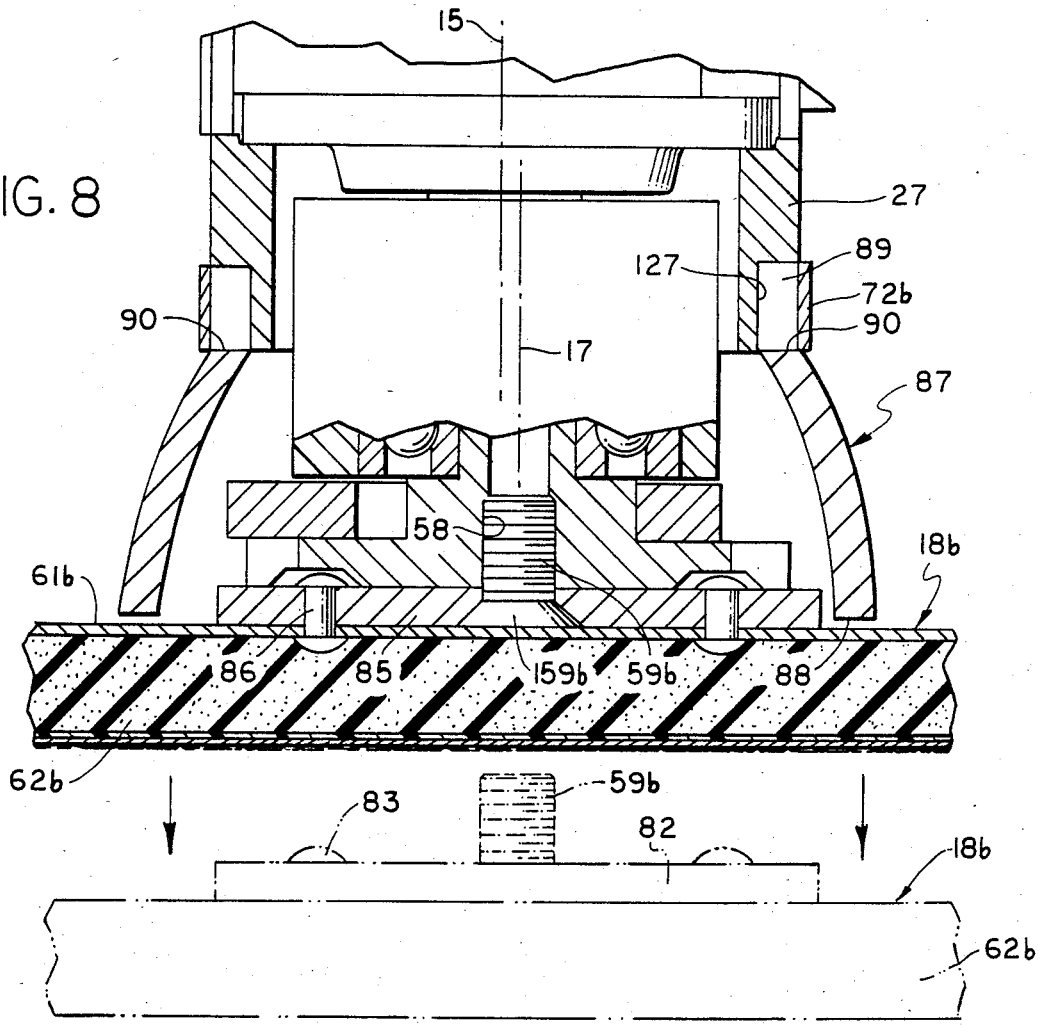

ORBITAL ABRADING OR POLISHING TOOL

BACKGROUND OF THE INVENTION

This invention relates to improved portable tools for abrading or polishing a workpiece.

In copending U.S. patent application Ser. No. 6/198,789 filed Oct. 20, 1980 and entitled "Powered Abrading Tool", there is disclosed a portable abrading or polishing tool having a circular head which is driven orbitally by a motor of the device through a drive mechanism including a carrier element which is driven rotatively about a first axis and a part connected to the carrier for rotation relative thereto about a second axis, with the head of the device being carried by that part for orbital movement therewith. The circular head carries a threaded projection connectable into a threaded bore in the specified part to which it is attached, with a sheet of sandpaper or the like being attached to the opposite side of the head for engagement with the workpiece. The abrading head in that prior application is free for unrestrained rotary movement about an axis extending through the center of the circular head in addition to the principal orbital movement of the head. In certain other prior art devices of this general type, the head has been held against such rotation by provision of an essentially tubular flexible rubber boot which is connected at opposite ends to the body of the tool and the head respectively to render the head 'captive' and free for only orbital movement.

SUMMARY OF THE INVENTION

A major purpose of the present invention is to provide an improved captive head type tool in which the head can be attached to and detached from the drive portion of the tool much more rapidly and easily than in prior similar devices, and in a manner enabling selective use of any of several different structurally very simple heads of different sizes and shapes with a single drive unit. That drive unit and a set of different heads can then serve in effect as a number of different tools. In addition, the head and the structure which is employed for retaining it against rotation are designed to minimize the overall weight of the orbiting portion of the tool and thereby facilitate counterbalancing of the device.

These results are achieved in large part by a unique interrelationship between the head, the drive mechanism and the tubular element which retains the head against rotation as it revolves orbitally. More particularly, the parts are designed so that tightening of a single threaded fastener acts simultaneously to attach the head to both the drive element by which it is powered orbitally and the flexible tubular member which holds it against rotation. For this purpose, the fastener acts to tighten the head toward the orbitally moving part by which it is driven, and the flexible tubular member carries at one of its ends means received and clamped axially between the head and the drive part and thereby attached securely to these elements by tightening of the screw. The means thus clamped may be a plate bonded to the flexible tubular member and extending across an end thereof and having a central opening through which the fastener extends.

BRIEF DESCRIPTION OF THE DRAWINGS

FIG. 7 is a perspective representation of the drive portion of the tool and a second form of removable head assembly which may be substituted for the rectangular head of FIGS. 1 to 3;

FIG. 8 is a view similar to FIG. 3, showing the device with a third form of head attached thereto; and FIG. 9 is a vertical section taken on line 9—9 of FIG. 4.

DESCRIPTION OF THE PREFERRED EMBODIMENTS

Figure 1:
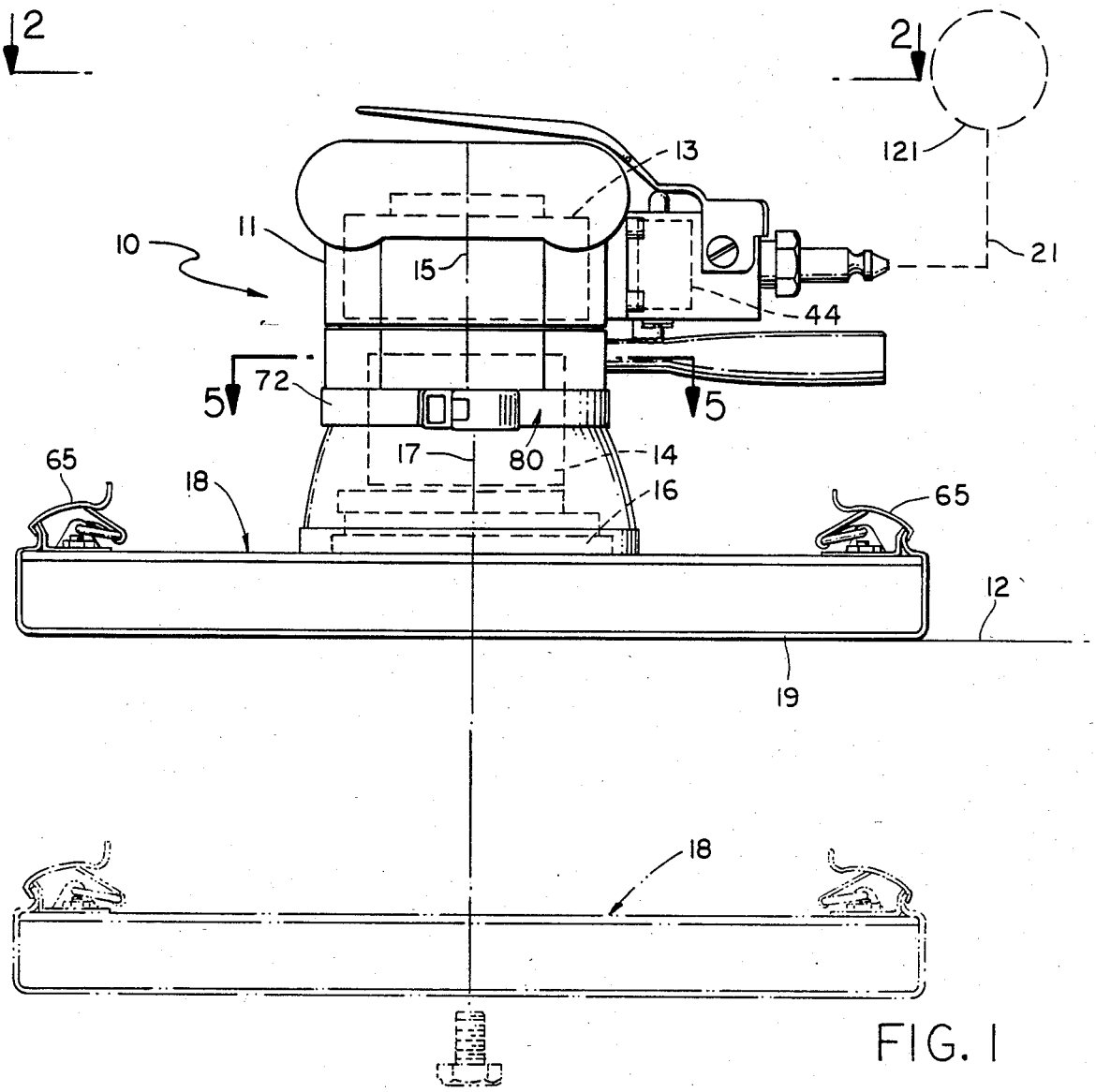
FIG. 1 is a side elevational view of a first form of portable sander constructed in accordance with the invention.

The tool 10 illustrated in the drawings is a power driven orbital sander having a body structure 11 shaped externally as a handle to be grasped by a user for holding the tool and moving it along a typically horizontal work surface 12 to sand or polish that surface. An air driven motor 13 contained within body structure 11 drives a carrier part 14 rotatively about a vertical axis 15, with a part 16 being connected to carrier 14 for rotation relative thereto about a second axis 17, in a relation driving an abrading head or shoe 18 and a carried sheet of sandpaper 19 orbitally about axis 15 to sand the surface 12. Air is supplied to motor 13 from a source 121 of compressed air through a line 21 connecting into the rear of body structure 11.

Figures 3, 3A:
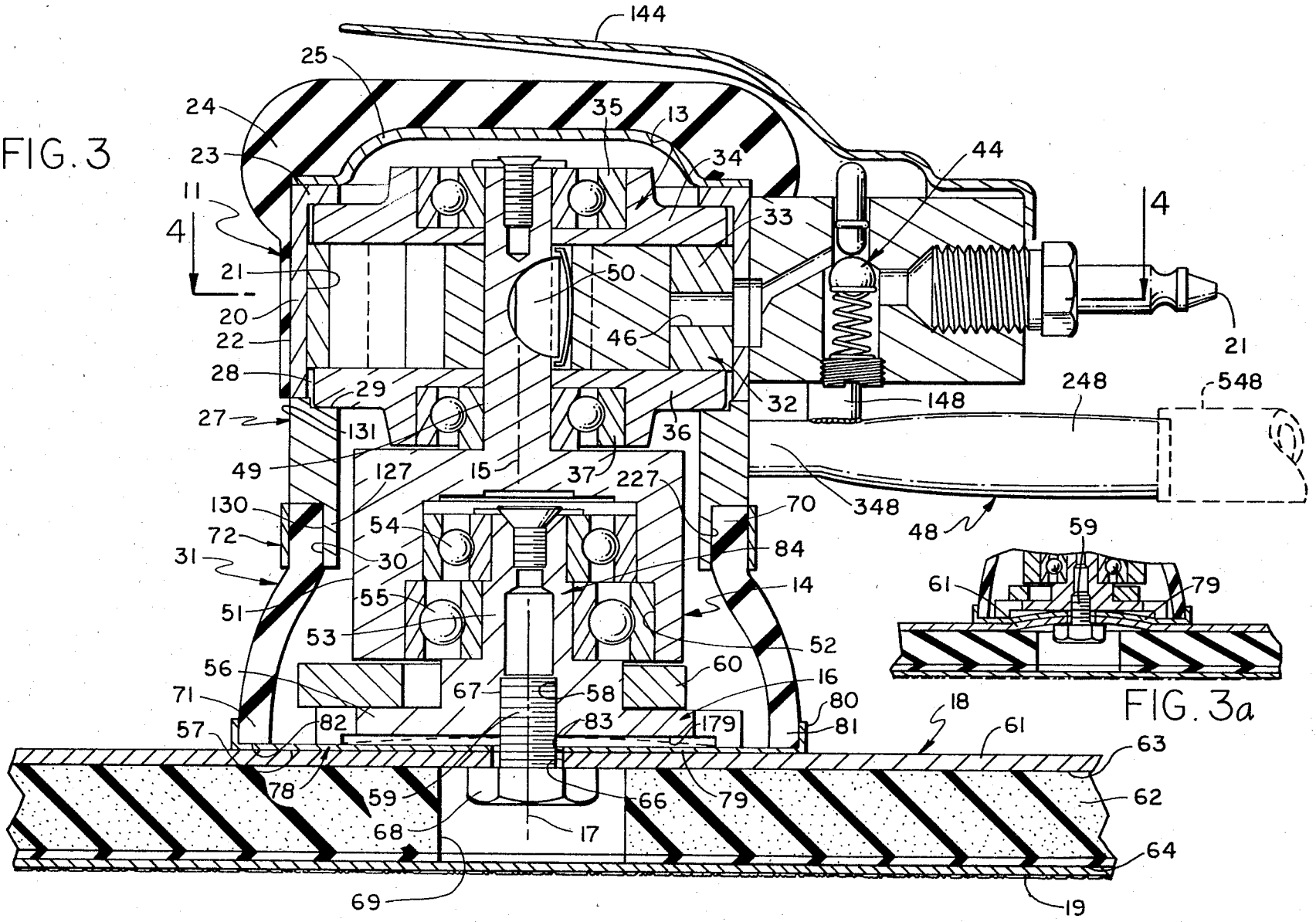
FIG. 3 is an enlarged vertical section taken on line 3—3 of FIG. 2.
FIG. 3A shows the retaining screw of FIG. 3 in its fully tightened condition.
Figure 6:
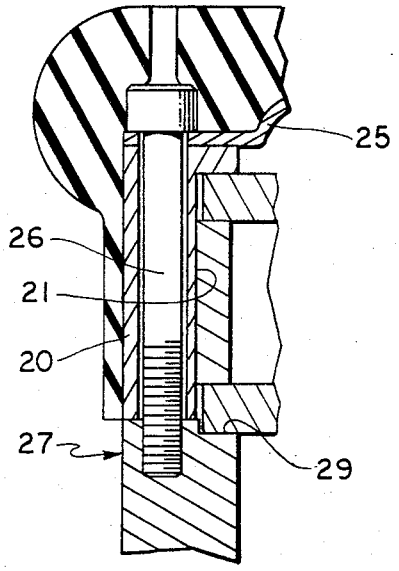
FIG. 6 is an enlarged fragmentary vertical section taken on line 6—6 of FIG. 2.

The body structure or assembly 11 may include a rigid metal main body part 20 having an internal cylindrical surface 21 defining a recess within which motor 13 is received. Part 20 may have an outer surface 22 of square horizontal section, and have an annular horizontal flange 23 at its upper end for confining the motor against upward removal from the body. A square cushioning element 24 may be carried about body part 20 and extend across its upper side, and may be formed of an appropriate rubber, to function as a cushioned handle element by which the device is held in use. A rigid reinforcing element 25 is bonded to the undersurface of the top horizontal portion of handle cushion 24, and with the attached part 24 is secured to body 20 by four screws 26 (FIG. 6) extending downwardly through vertical aligned openings or passages in parts 20 and 25, with the heads of the screws engaging downwardly against part 25, and with the lower ends of the screws being connected threadedly to a retainer 27 which is tightenable upwardly against the motor to retain it in the recess 28 formed within the body structure. As seen in FIGS. 3 and 6, the radially inner portion of retainer 27 forms an upwardly facing annular horizontal shoulder surface 29 which projects inwardly beyond surface 21 to block downward withdrawal of the motor. The lower portion of retainer 27 forms a skirt 127 centered about axis 15 and having a cylindrical internal surface 227 and an essentially cylindrical external surface 30 whose lower portion may be annularly knurled or otherwise irregularized at 130 for clamping of a tubular member or boot 31 thereto. The portion 131 of retainer 27 above surface 30 may be of essentially the same externally square configuration as surface 22 of body part 20 for vertical alignment of the outer surface of portion 131 with that surface 22 of part 20.

Figure 4:
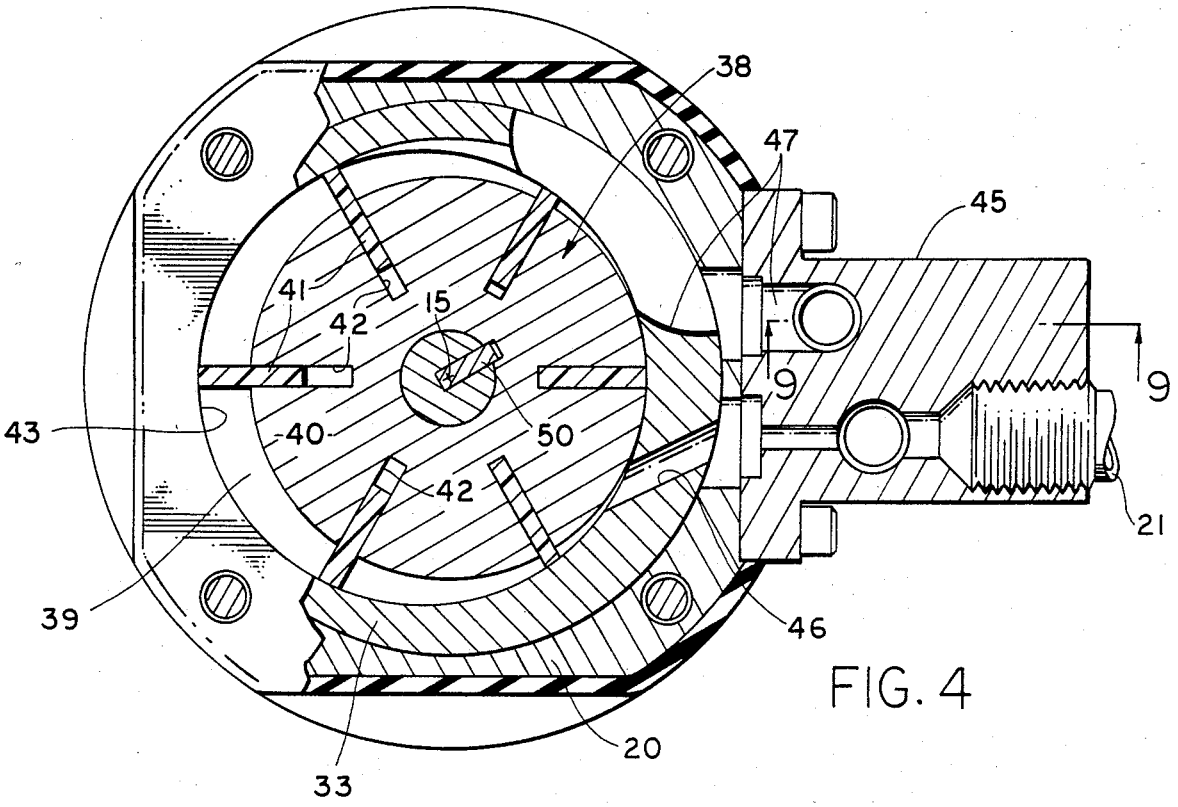
FIG. 4 is a horizontal section taken on line 4—4 of FIG. 3.

As seen in FIG. 3, the motor 13 may have a sectionally formed stator or housing 32 including a vertically extending side wall 33, a top wall 34 carrying a bearing 35 and a bottom wall 36 carrying a second bearing 37. These parts are externally circular and confined within recess 28 and clamped rigidly between retainer 27 and flange 23 by tightening of screws 26. A rotor assembly 38 is driven rotatively about axis 15 within chamber 39 in the stator, and includes a rotor body 40 and a series of radially extending vanes 41 received within radial grooves 42 in body 40 and movable radially inwardly and outwardly as the rotor turns (see FIG. 4). The outer extremities of the vanes contact an internal cylindrical surface 43 of side wall 33 of the stator, which surface is eccentric with respect to the rotary axis 15 of the motor. Compressed air is delivered to chamber 39 of the motor from inlet 21 through a manually actuable valve 44 contained within a block 45 attached to body 20, and flows from the valve through a passage 46 in wall 33 into chamber 39. Air discharges from the chamber through passages 47 in parts 33, 20 and 45, and exhausts to the atmosphere through a discharge structure 48 rigidly connected to block 45 and including a tube 148 brazed to and projecting downwardly from block 45, in communication with passages 47, and a horizontally extending tube 248 brazed to tube 148. Tube 248 may have a flattened portion 348 of rectangular vertical section at its left end as viewed in FIG. 9, with that portion being located by confinement within a correspondingly rectangular opening 448 formed in retainer 27. Air from the motor discharges rightwardly from the circular right end of tube 248, to which a short length of hose 548 may be connected if desired to function as a silencer carrying the sound of the exhausting air away from the operator.

The carrier 14 which is driven by the rotor of motor 13 may have an upper relatively small diameter externally cylindrical shaft portion 49 connected to the rotor for rotation therewith by a key 50 received within opposed grooves in the rotor and shaft. The shaft 49 is journalled by bearings 35 and 37 for rotation about axis 15. Beneath the level of lower bearing 37, carrier part 14 has an enlarged portion 51 which is typically externally cylindrical about axis 15, and which contains a recess 52 centered about the second axis 17 which is parallel to but offset laterally from axis 15. The orbitally driven part 16 has an upper reduced diameter portion 53 which projects upwardly into recess 52 and is centered about axis 17 and is journalled by two bearings 54 and 55 for rotation about axis 17 relative to carrier 14, so that as the carrier turns the part 16 is given an orbital motion. A lower enlarged diameter flange portion 56 of part 16 has an annular horizontal undersurface 57 disposed transversely of axis 17. A threaded bore 58 extends upwardly into part 16 and is centered about vertical axis 17, for engagement with an externally threaded screw 59 which detachably secures head 18 to the rest of the device. A counterweight plate 60 may be located vertically between carrier 14 and flange 56 of part 16, and be secured rigidly to part 14 by appropriate fasteners, and may be externally noncircular about axis 15 to counterbalance the eccentrically mounted part 16, head 18, and other connected elements.

Figure 2:
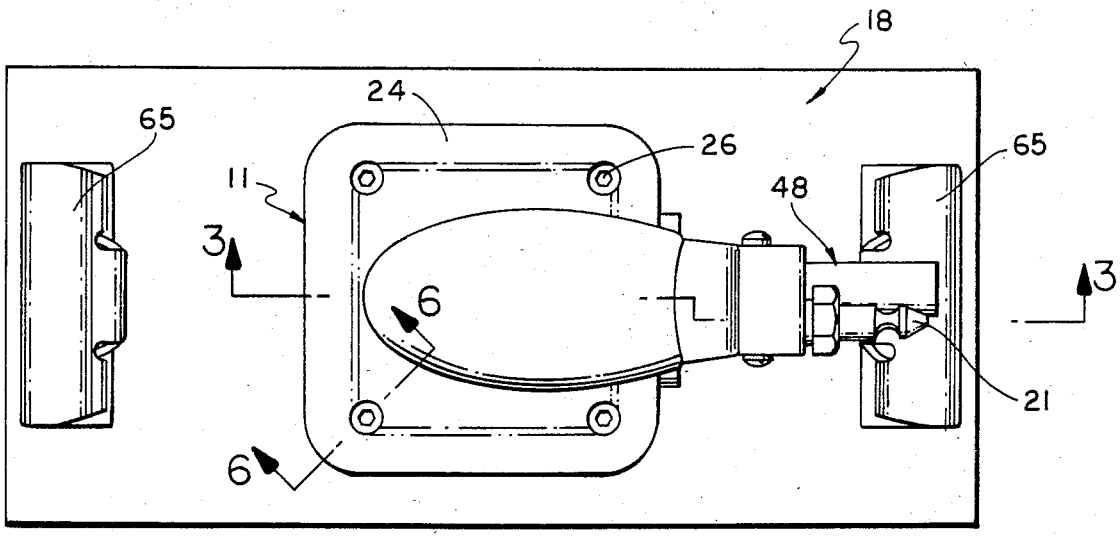
FIG. 2 is a plan view of the FIG. 1 sander, taken on line 2—2 of FIG. 1.

The head 18 of FIGS. 1 to 3 is rectangular in horizontal section, and includes an upper horizontally rectangular rigid flat metal backing plate 61 having a rectangular resiliently deformable cushion 62 at its underside typically formed of foam rubber or the like, and bonded continuously to plate 61 at 63. The rectangular sheet of sandpaper 19 extends along the horizontal undersurface 64 of cushion 62 of the head, and then extends upwardly at opposite ends of the head for retention of its ends by two clips 65. At its center, plate 61 contains an opening 66 which may be circular and of a diameter to pass upwardly therethrough the threaded shank 67 of screw 59, with the enlarged preferably hexagonal head 68 of the screw being tightenable upwardly against the plate about opening 66. An opening or passage 69 formed in pad 62 enables a wrench to be inserted upwardly into that passage and about head 68 of the screw to attach the head to the main drive portion or housing and motor assembly 84 of the tool, or remove it therefrom.

Figure 5:
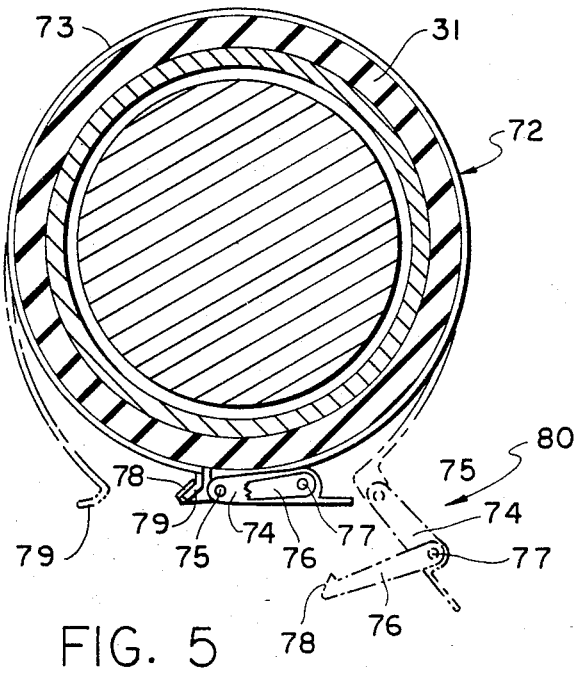
FIG. 5 is a horizontal section taken on line 5—5 of FIG. 1.

The tubular part 31 connects the orbitally driven head 18 to the body structure 11 of the tool in a manner retaining the head against rotation while at the same time permitting orbital movement thereof. Member 31 extends about parts 14, 16 and 60, and is formed of a flexible material, preferably an appropriate elastomeric material such as rubber. Member 31 is molded to a normally annular configuration, but is distorted slightly in use from that annular configuration so that the upper annular end 70 of member 31 is centered about axis 15 while the lower annular end of member 31 is centered about the orbitally moving axis 17. The upper end 70 is substantially cylindrical both internally and externally, and is a close fit about the outer surface 30 of retainer 27, and is detachably clamped against that surface by a preferably quick release clamp assembly 72. As seen in FIG. 5, this assembly may typically include an approximately annular strap 73 having a part 74 connected pivotally to one end of the strap at 75, with an element 76 being pivoted to part 74 at 77 and having an end portion 78 engageable with a hook 79 formed on the other end of the strap. By swinging part 74 about axis 75 in a counterclockwise direction as viewed in FIG. 5, with element 76 connected to hook 79, the take-up assembly 80 tightens strap 73 about the upper end of member 31 and retains the strap in that tightened condition by movement of pivotal axis 77 to a slightly overcenter position with respect to axis 75. In lieu of this clamp arrangement, any other type of retaining structure may be provided for encircling the upper end of member 31 and tightening it against surface 30 of retainer 27.

The lower end 71 of member 31 carries and is attached permanently to a plate 78 preferably formed of sheet metal which is essentially rigid and in particular is substantially more rigid and stiff than the flexible elastomeric material of which part 31 is formed. Plate 78 has a planar circular portion 79 extending transversely of the two axes 15 and 17 and parallel to the upper surface of plate 61 of head 18. At its periphery, plate 78 has an upwardly turned cylindrical side wall portion 80 centered about axis 17 and fitting closely about the lower externally cylindrical portion 81 of rubber part 31. The bottom annular surface 82 of member 31 extends transversely of axis 17 and is received closely adjacent the upper surface of transverse portion 79 of plate 78. Plate 78 is attached to the lower end of member 31 in fixed relation, preferably by bonding the lower portion of member 31 annularly to plate 78, either by provision of an adhesive between the lower edge surface 82 and portion 79 of the plate and between the outer surface of portion 81 of member 31 and portion 80 of the plate, or by curing the rubber of member 31 while in contact with plate 78 to form an annular vulcanization bond between the parts in which the rubber itself directly adheres to the inner surface of portion 80 of the plate and the upper surface of portion 79 of the plate.

As seen in FIG. 3, portion 79 of plate 78 extends radially inwardly toward axis 17 at a location vertically between orbitally moving drive part 16 and plate 61 of head 18, and contains a central circular opening 83 centered about axis 17 and just slightly larger in diameter than the shank 67 of screw 59. As the screw is tightened upwardly against plate 61, the plates 61 and 78 are both clamped tightly between the head 68 of the screw and part 16, enabling this single screw to secure the head simultaneously to both the orbital drive part 16 and the flexible element 31. Radially inwardly of the annular downwardly facing surface 57 of part 16, that part may be recessed slightly upwardly to present a horizontal downwardly facing surface 179 offset slightly above the plane of surface 57, so that upon final tightening the screw may deform the central portions of plates 61 and 79 slightly upwardly to the bowed condition represented in broken lines in FIG. 3 and in full lines in FIG. 10. In that bowed condition, the portion of plate 79 directly above head 68 of the screw directly engages surface 179 adjacent opening 83, to enhance and render more positive and effective the connection between the parts. To attain this action, the metal of plates 61 and 79 is slightly resiliently deformable, so that these plates may deform to the discussed bowed condition and then return to their normal plan condition upon detachment of screw 59.

FIG. 7 illustrates the drive assembly or motor and handle assembly 84 of FIG. 1 as it appears when detached from head 18 by removal of screw 59. FIG. 7 also shows in conjunction with the drive assembly 84 a second type of sanding head **18*a* which may be attached to the drive assembly 84 by screw 59 in lieu of rectangular head 18. This head 18*a* is circular about axis 17*a* corresponding to axis 17 of head 18, and includes an upper flat horizontal metal plate 61*a* which is circular about axis 17*a* and a resilient cushion 62*a* also circular about that axis and adhered to the underside of plate 61*a*. Plate 61*a* contains a central opening 66*a* through which the screw 59 is connectable upwardly for attachment into bore 58 to secure the head thereto. As will be understood, a central opening is also formed in cushion 62*a* for reception of the head 68 of the screw, and to enable a tool to engage that head and either tighten or loosen the screw. As the screw is tightened upwardly into bore 58 in part 16, the head of the screw acts upwardly against plate 61*a* of head 18*a* and clamps portion 79 of plate 78 tightly between plate 61*a* and part 16 to simultaneously attach the head 18 to both the part 16 and member 31 through plate 78. Thus, the head 18*a* may be substituted for head 18 or vice versa by merely loosening the single screw 59 to detach one of the heads and then inserting the screw through the central opening in the other head and through opening 83 in plate 78 and into bore 58, for tightening thereinto, to secure the substitute head to the device in proper operating position, all without the necessity for removing the rubber member 31 or its attached plate 78 or the clamp 72** which retains these parts to the handle body of the device.

FIG. 8 illustrates another abrading head **18*b* which may be attached to the main body of the tool, and which is of a non-captive type allowing completely free rotation of the head about the secondary axis 17 as the head is driven orbitally about the main axis 15 of the motor. Head 18*b* may have a top flat horizontal rigid metal backing plate 61*b* which is circular about axis 17 and carries a similar circular elastomeric pad 62*b* at its underside. A screw 59*b* of head 18*b* may be attached permanently to the head, and project upwardly therefrom, so that the upper threaded shank of this screw may be connected into the bore 58 by manipulating and turning the head. Screw 59*b* may have its lower enlarged head portion 159*b* clamped between plate 61*b* and a disc 85 connected to plate 61*b* by rivets 86, in a relation rigidly securing the screw to plate 61*b*** and against rotation relative thereto.

When the head **18*b* is to be utilized, clamp 72 is loosened to allow it and its carried rubber part 31 and plate 78 to be detached from the rest of the drive unit 84, after which a tubular shroud member 87 is connected to retainer 27 of the body structure of the device in substitution for member 31. Member 87 projects downwardly from the body of the tool about parts 14, 16 and 60, with the lower annular edge 88 of member 87 being received in close proximity to but spaced slightly from the upper horizontal surface of plate 61*b*. Member 87 is annular about axis 15 of the device, and may be formed of an appropriate essentially rigid or stiff material such as a rigid resinous plastic material or metal. The upper edge 89 is detachably but rigidly connectable to the retainer 27 in appropriate manner, as by a clamp 72*b* typically corresponding to clamp 72 of the first form of the invention. Edge 89 of member 87 may be interrupted by axial slits 90, preferably two such slits at diametrically opposite locations, to enable slight constriction of this edge portion against sleeve portion 127 of retainer 27** for rigid connection thereto.

In using the tool, any one of the three heads 18, **18*a* or 18*b* may be quickly and easily attached to the main portion of the tool when desired, giving a user the equivalent of three tools with a single body and motor assembly. For example, in order to attach head 18 to the tool, the head may be moved relative to the main drive assembly 84 from the broken line position of FIG. 1 to the full line position of that figure, after which screw 59 may be inserted upwardly through the openings in plates 61 and 78 and into bore 58 to attach the head to members 16 and 31 as discussed. After a sheet of sandpaper has been connected to the underside of head 18, the user may grasp body structure 11 and actuate valve 44 by downward movement of valve actuating lever 144 to place the motor in operation. Air supplied to the motor turns carrier 14 about axis 15 and similarly causes part 16 and head 18 to revolve orbitally about axis 15 to attain an orbital sanding action on work surface 21**.

Head **18*a* may be attached to the drive unit in the same manner discussed in connection with head 18, and head 18*b* may be attached in conjunction with part 87. In the arrangements of FIGS. 7 and 8**, a sandpaper disc can be attached to the head by adhesive.

While certain specific embodiments of the present invention have been disclosed as typical, the invention is of course not limited to these particular forms, but rather is applicable broadly to all such variations as fall within the scope of the appended claims.

We claim:

1. A portable abrading or polishing tool comprising:
a body structure adapted to be held by a user to manipulate the tool;
a motor carried by said body structure;
a carrier driven rotatably about a first axis by said motor;
a part which is connected to said carrier for rotation relative thereto about a second axis offset from said first axis to drive said part orbitally as the carrier turns;
said part having a thread centered essentially about said second axis;
a head to be driven orbitally by said part and adapted to carry an element for abrading or polishing a workpiece;
a threaded fastener adapted to be connected detachably to said thread of said part and acting to attach said head to said part for orbital movement therewith;
a generally tubular member of flexible material for retaining said head against rotation while permitting orbital movement thereof and having a first end connected to said body structure; and
means carried by said flexible generally tubular member at a second end thereof and projecting inwardly essentially toward said second axis at a location to be confined axially between said head and said part and thereby attach said head to said flexible generally tubular member upon tightening of said fastener along said second axis relative to said part.

2. A portable abrading or polishing tool as recited in claim 1, in which said thread of said part is an internal thread formed in a bore in said part and centered about said second axis, said fastener being a screw having an external thread projecting into said bore.

3. A portable abrading or polishing tool as recited in claim 1, in which said head has a plate containing an opening, said fastener being a screw having an externally threaded shank extending through said opening and connectable to said thread of said part, said screw having an enlarged head adapted to apply force to said plate of the head to secure it to said part and clamp said means axially between said head and said part.

4. A portable abrading or polishing tool as recited in claim 1, in which said means include an element formed separately from said generally tubular member and of a material more rigid than said tubular member and secured to said second end thereof, and projecting generally radially inwardly therefrom toward said second axis to a location to be clamped between said head and said part upon tightening of said fastener.

5. A portable abrading or polishing tool as recited in claim 1, in which said means include a plate formed separately from and more rigid than said flexible generally tubular member and bonded to said second end thereof.

6. A portable abrading or polishing tool as recited in claim 1, in which said generally tubular member is formed of a resiliently deformable elastomeric material, and said means carried by said generally tubular member at said second end thereof are formed of a material more rigid than said generally tubular member.

7. A portable abrading or polishing tool as recited in claim 1, including an essentially annular clamp received about said first end of said tubular member and adapted by radial constriction inwardly thereagainst to secure said first end detachably to said body structure.

8. A portable abrading or polishing tool as recited in claim 1, in which said head includes a plate containing an opening and a cushion attached to the underside of the plate and containing an opening aligned with said opening in the plate, said fastener being a screw having a shank extending upwardly through said opening in the plate for attachment to said thread of said part and having an enlarged head for applying force upwardly to the plate.

9. A portable abrading or polishing tool as recited in claim 1, including a second head which is connectable to said part by said fastener in substitution for said first mentioned head, with said means clamped axially between said second head and said part by tightening of the fastener.

10. A portable abrading or polishing tool as recited in claim 1, in which said body structure includes a first body element containing a recess within which said motor is received, and a second body element connectable to the underside of said first body element and acting to retain said motor in said recess, said first end of said flexible generally tubular member being received about said second body element, and means extending about said first end of said generally tubular member and adapted to tighten it radially inwardly against said second body element to secure the generally tubular member thereto.

11. A portable abrading or polishing tool as recited in claim 1, in which said head includes an essentially rectangular plate containing an opening through which said fastener extends to secure the head to said part, an essentially rectangular cushion at the underside of said plate, and clip means for securing a sheet of abrading material to said head.

12. A portable abrading or polishing tool as recited in claim 1, in which said head includes an essentially circular plate containing a central opening through which said fastener extends, with said means received axially between said plate and said part, said head including an essentially circular cushion carried at the underside of said plate.

13. A portable abrading or polishing tool comprising:
a body structure adapted to be held by a user to manipulate the tool;
a motor carried by said body structure;
a carrier driven rotatably about a first axis by said motor;
a part which is connected to said carrier for rotation relative thereto about a second axis offset from said first axis to drive said part orbitally as the carrier turns;
said part containing a bore with an internal thread centered about said second axis;
a head to be driven orbitally by said part and adapted to carry a sheet of material for abrading or polishing a workpiece;
said head including a plate containing an opening and including a cushion carried at the underside of said plate;
a screw having a shank adapted to project through said opening and having an external thread engageable with said internal thread in said bore;
said screw having an enlarged head acting to apply force tightening said plate toward said part by rotation of the screw about said second axis relative to said part, and acting to thereby attach the head to said part for orbital movement therewith;

a generally tubular member of elastomeric material for retaining said head against rotation while permitting orbital movement thereof, and having a first end connected to said body structure and a second end received near said plate of said head; and an element secured to said second end of said generally tubular member and formed of a material more rigid than said elastomeric material of said generally tubular member and projecting generally radially inwardly essentially toward said second axis at a location to be clamped axially between said plate and said part and thereby attach said head to said generally tubular member upon tightening of said screw along said second axis into said bore of said part.

14. A portable abrading or polishing tool as recited in claim 13, in which said element is bonded essentially peripherally and essentially annularly to said second end of said generally tubular member of elastomeric material.

15. A portable abrading or polishing tool as recited in claim 14, in which said element is a metal plate disposed substantially directly transversely of said second axis and essentially parallel to said plate of the head and containing a central opening through which said shank of the screw extends.

16. A portable abrading or polishing tool as recited in claim 15, in which said first end of said generally tubular member is received about a portion of said body structure, there being an essentially annular clamp extending about said first end of said generally tubular member and tightening it inwardly against said body structure to secure the generally tubular member thereto.

17. A portable abrading or polishing tool comprising:

a body adapted to be held by a user to manipulate the tool and containing a downwardly opening recess;

a rotary air motor contained in said recess;

a retainer connected to the underside of said body and retaining said motor in said recess and against removal downwardly therefrom;

said retainer having an essentially circular external surface;

a carrier which is connected to said motor at its underside and is driven rotatably about a first axis by the motor;

said carrier containing a downwardly facing recess;

bearing means contained within said recess in the carrier;

a part mounted by said bearing means to said carrier for rotation relative thereto about a second axis offset from but essentially parallel to said first axis in a relation driving said part orbitally as the carrier turns;

said part containing a bore opening downwardly and having an internal thread centered about said second axis;

a power driven head to be connected to and driven orbitally by said part and which includes a plate containing an opening, and includes a cushion of resiliently deformable material at the underside of said plate and against which a sheet of abrading or polishing material is receivable;

a screw having a shank adapted to extend upwardly through said opening in said plate with an external thread engageable with said internal thread in said bore to attach the plate and cushion to said part for orbital movement therewith;

an essentially tubular member of elastomeric material disposed about said carrier and said part for connecting said power driven head to said body and retainer to hold the head against rotation while permitting said orbital movement thereof;

said tubular member having a first end disposed about said essentially circular external surface of said retainer;

a generally annular clamp structure to be received about said first end of said tubular member and tighten it radially inwardly against said circular external surface of the retainer in a relation attaching said first end of said tubular member to the retainer and body; and an essentially circular plate formed separately from said essentially tubular member and of a material more rigid than said elastomeric material of said essentially tubular member and which has a peripheral portion bonded essentially annularly to a second end of said essentially tubular member;

said essentially circular plate extending radially inwardly essentially transversely of said axes and essentially parallel to said plate of said head and containing an opening through which said shank of said screw extends, with said essentially circular plate being located axially between said plate of said power driven head and said part, and adapted to be clamped tightly therebetween upon tightening of said screw into said bore.

* * * * *